US009602912B2

(12) United States Patent
Wen

(10) Patent No.: US 9,602,912 B2
(45) Date of Patent: Mar. 21, 2017

(54) HIGH BASS SPEAKER MONOMER AND A HIGH BASS EARPHONE STRUCTURE

(71) Applicant: Transound Electronics Co., Ltd., Dongguan (CN)

(72) Inventor: Tsengfeng Wen, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 42 days.

(21) Appl. No.: 14/427,636

(22) PCT Filed: Dec. 19, 2013

(86) PCT No.: PCT/CN2013/089923

§ 371 (c)(1),
(2) Date: Mar. 12, 2015

(87) PCT Pub. No.: WO2014/094625

PCT Pub. Date: Jun. 26, 2014

(65) Prior Publication Data

US 2015/0249878 A1 Sep. 3, 2015

(30) Foreign Application Priority Data

Dec. 21, 2012 (CN) ..... 2012 2 0713482 U

(51) Int. Cl.
*H04R 25/00* (2006.01)
*H04R 1/10* (2006.01)
(Continued)

(52) U.S. Cl.
CPC ..... *H04R 1/1058* (2013.01); *H04R 1/24* (2013.01); *H04R 1/1008* (2013.01); *H04R 1/2811* (2013.01)

(58) Field of Classification Search
CPC ..... H04R 1/28; H04R 1/24
(Continued)

(56) References Cited

U.S. PATENT DOCUMENTS 4,239,945 A * 12/1980 Atoji ..... H04R 1/2819 381/349
6,775,390 B1 * 8/2004 Schmidt ..... H04M 1/05 181/128
(Continued)

FOREIGN PATENT DOCUMENTS

CN 201238372 Y * 5/2009

*Primary Examiner* — Md S Elahee
*Assistant Examiner* — Julie X Dang
(74) *Attorney, Agent, or Firm* — Leong C. Lei

(57) ABSTRACT

A high bass speaker monomer comprises a framework, a magnetic air loop component and a vibration membrane. The frame work is disposed at a central position of the frame work. A hollow structure is formed on the framework and around the magnetic air loop component. An isolation ring formed on the framework divides the hollow structure into at least one high tone region and bass region respectively located near and far away from the magnetic air loop component. The vibration membrane is disposed on the framework and covers the magnetic air loop component and the two regions. The high bass speaker monomer is disposed in a casing body to construct a high bass earphone structure. The isolation ring separates the high tone from the low tone to prevent them from mixing. Therefore, the sound of the earphone is more stable and the quality of the sound is better.

9 Claims, 4 Drawing Sheets

(51) Int. Cl.
*H04R 1/24* (2006.01)
*H04R 1/28* (2006.01)

(58) Field of Classification Search
USPC ..... 381/370, 372, 374, 371, 349
See application file for complete search history.

(56) References Cited

U.S. PATENT DOCUMENTS

| | | | | |
|---|---|---|---|---|
| 8,447,058 | B1 * | 5/2013 | Sung | H04R 1/2826 381/370 |
| 8,588,453 | B1 * | 11/2013 | Lee | H04R 1/1008 381/370 |
| 8,837,764 | B2 * | 9/2014 | Chou | H04R 1/2811 379/433.02 |
| 8,861,766 | B2 * | 10/2014 | Ouryouji | H04R 1/1058 381/370 |
| 2004/0218775 | A1 * | 11/2004 | Huang | H04R 1/1075 381/371 |
| 2007/0154049 | A1 * | 7/2007 | Levitsky | H04R 1/1083 381/371 |
| 2013/0077800 | A1 * | 3/2013 | Pan | H04S 3/004 381/74 |
| 2013/0223669 | A1 * | 8/2013 | Chen | H04R 1/2803 381/370 |
| 2013/0343579 | A1 * | 12/2013 | Chou | H04R 1/2811 381/160 |

* cited by examiner

HIGH BASS SPEAKER MONOMER AND A HIGH BASS EARPHONE STRUCTURE

TECHNICAL FIELD OF THE INVENTION

This invention relates to a speaker, particularly to a high bass speaker monomer and a high bass earphone structure.

DESCRIPTION OF THE PRIOR ART

Generally, a conventional earphone can be divided into a moving coil type, a moving iron type, an electrostatic type and an isodynamic type according to the transduction form. The earphone can also be divided into a half-open type and a closed type according to the structure. The earphone can be divided into a plug-in type, an ear-hanging type, an in-ear type and a headband type according to the carrying form.

A conventional earphone structure mainly includes a body, an interior of which forms a chamber. A speaker is mounted in the chamber. In use, sounds coming out from the speaker spread outwards, and the spread of the sounds is around a sound source. The volume of the place located nearest the sound source is the loudest. The volume of the place where the sounds spread around is gradually down. The conventional earphone only has one sound room, i.e. the chamber, which causes the high tone and the low tone to enter the same sound room and surround and thus causes the high tone to mix with the low tone. Thus, the sound of the conventional earphone is not stable and the sound quality is not good as well.

SUMMARY OF THE INVENTION

The object of this invention is to overcome the problems of the conventional structure presented supra and provide a high bass speaker monomer and a high bass earphone structure which solve the conventional problem of the unstable sound and bad sound quality of the earphone caused by mixing the high tone with the low tone in one sound room.

To obtain the above object, the technique of this invention is described as follows:

A high bass speaker monomer in accordance with this invention comprises a framework, a magnetic air loop component and a vibration membrane. The magnetic air loop component is disposed at a central position of the framework. A hollow structure is formed on the framework and around an outer periphery of the magnetic air loop component. An isolation ring is formed on the framework. The isolation ring divides the hollow structure into at least one high tone region and at least one bass region. The high tone region is located near the magnetic air loop component. The bass region is located far away from the magnetic air loop component. The vibration membrane is disposed on the framework and covers the magnetic air loop component, the high tone region and the bass region.

Preferably, this invention further comprises a cover plate. The cover plate is fixed to the framework and disposed above the vibration membrane so that the cover plate covers the vibration membrane. A set of sound holes is formed on the cover plate.

Preferably, the set of sound holes comprises a first sound hole and a second sound hole. The first sound hole communicates with the high tone region. The second sound hole communicates with the bass region.

Preferably, a plurality of first sound holes and a plurality of second sound holes can be formed on the cover plate. The first sound holes and the second sound holes are circumferentially arranged. The second sound holes are arranged around an outer periphery of the first sound holes.

Preferably, this invention further comprises a division covet. The division cover is connected to a lower portion of the isolation ring and located below the magnetic air loop component.

A high bass earphone structure in accordance with this invention comprises a casing body and the high bass speaker monomer as aforementioned. A chamber is enclosed by an interior of the casing body. The high bass speaker monomer is mounted within the chamber.

Preferably, the casing body includes a rear casing and an annular baffle fixed to the rear casing. The annular baffle and the rear casing are combined to form the chamber. The high bass speaker monomer is embedded in an inner wall of the annular baffle.

Preferably, an annular ear cap is fixed to a surface of the annular baffle.

Preferably, the high bass speaker monomer further comprises a division cover connected to a lower portion of the isolation ring and located below the magnetic air loop component. The division cover is disposed within the chamber to divide the chamber into sound rooms for receiving sounds with different audio frequencies. The sound rooms comprise a first sound room and a second sound room. The second sound room is disposed around an outer periphery of the first sound room for surrounding the first sound room.

By comparison with the conventional structure, this invention has following advantages and effects:

1. By the isolation ring formed on the framework, the isolation ring divides the hollow structure into at least one high tone region and at least one bass region to separate the high tone from the low tone and prevent two tones from mixing together, whereby the sound of the earphone is more stable and the quality of the sound (timbre) is better.
2. By the division cover connected to the isolation ring, the division cover divides the chamber into at least two sound rooms to allow the high tone and the low tone to enter different sound rooms respectively, thereby increasing the sound quality of the earphone.
3. By arranging multiple first sound holes and second sound holes which are circumferentially arranged on the cover plate and arranging the second sound holes around an outer periphery of the first sound holes, high tones enter from the first sound holes into the first sound room evenly, and low tones enter from the second sound holes into the second sound room evenly. Therefore, the homogeneity and stability of the sound of the earphone can be increased.

The advantages of this invention over the known prior arts are more apparent to those of ordinary skilled in the art upon reading following descriptions in conjunction with the accompanying drawings.

DETAILED DESCRIPTION OF THE PREFERRED EMBODIMENTS

Figure 1:
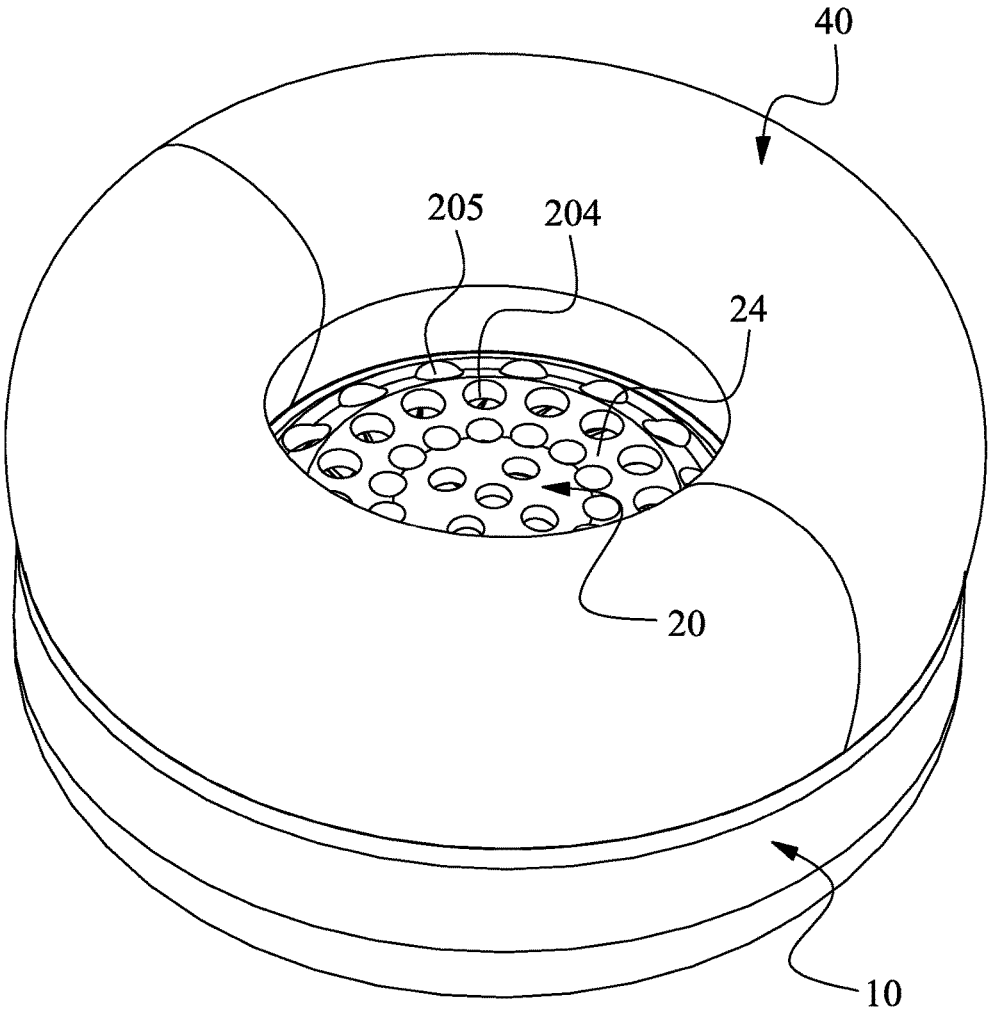
FIG. 1 is a perspective view showing a preferred embodiment of this invention.
Figure 2:
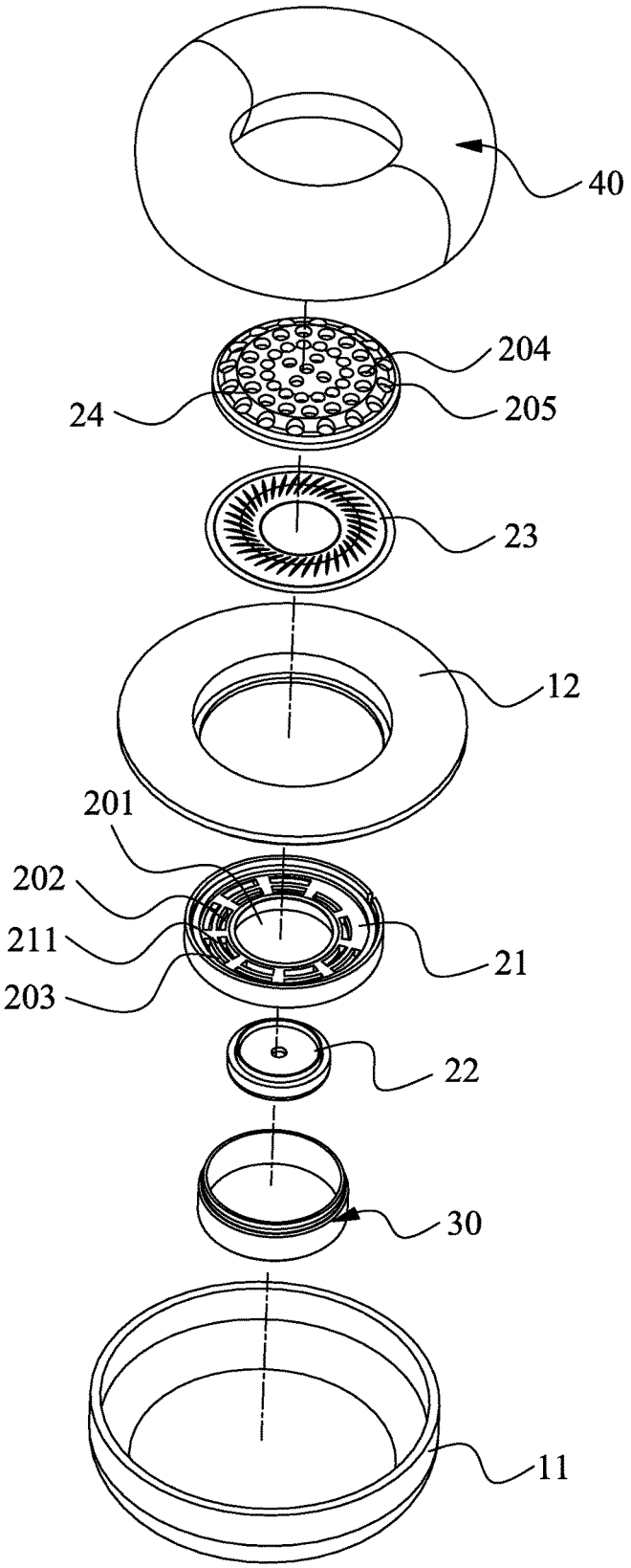
FIG. 2 is an exploded view showing the preferred embodiment of this invention.
Figure 3:
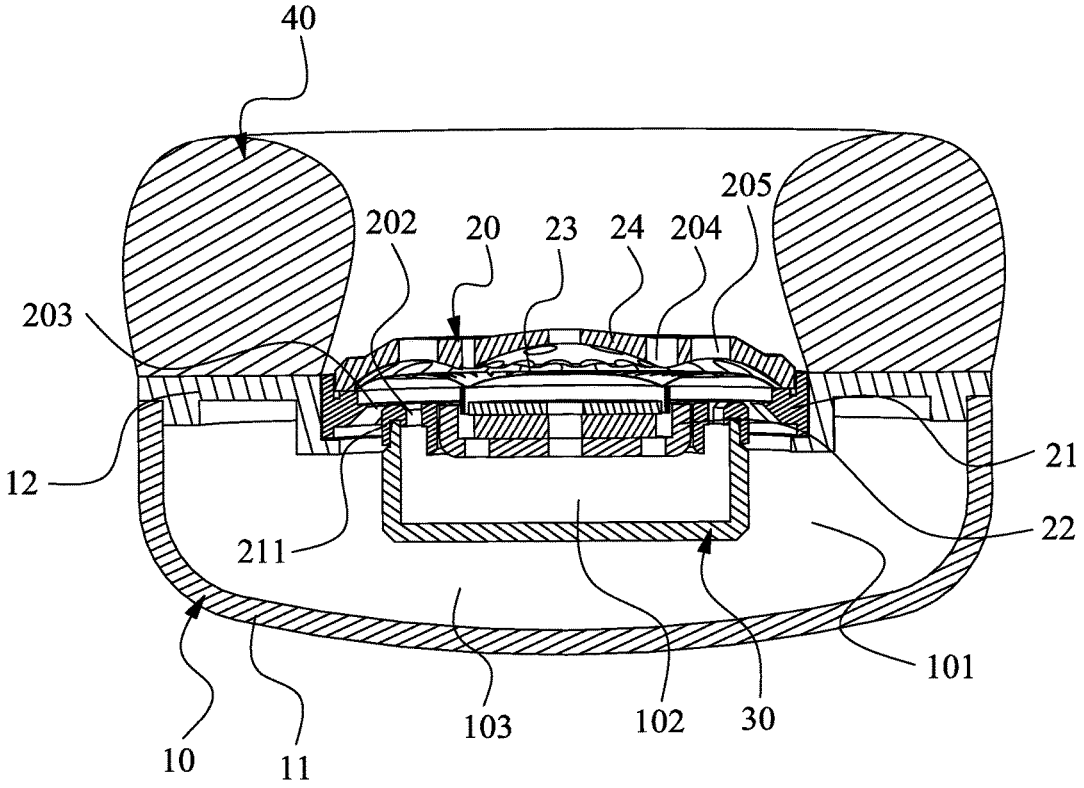
FIG. 3 is a cross-sectional view showing the preferred embodiment of this invention.
Figure 4:
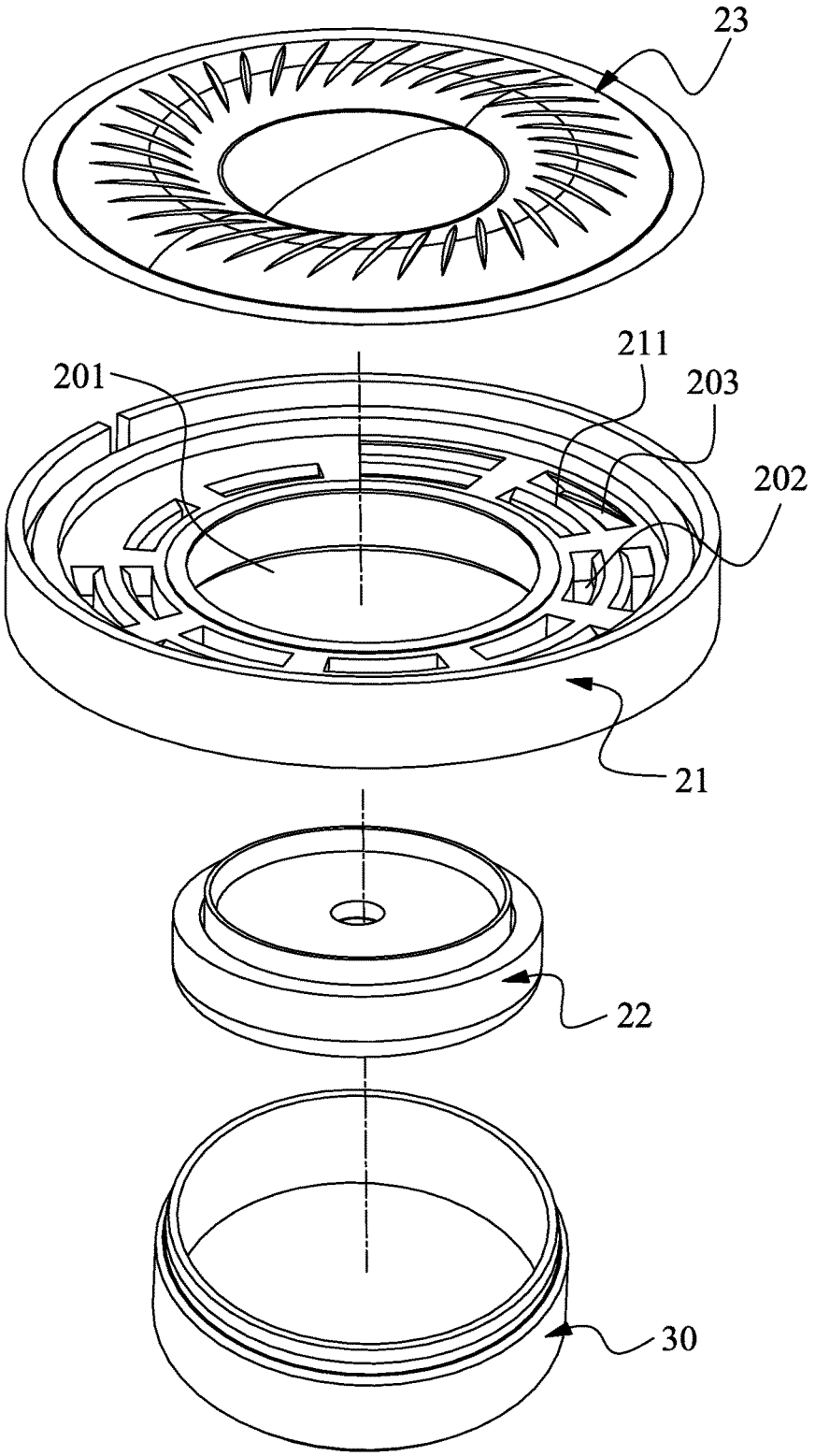
FIG. 4 is an exploded view showing the high bass speaker monomer of the preferred embodiment of this invention.

FIGS. 1-4 show a preferred embodiment of this invention which comprises a casing body 10 and a high bass speaker monomer 20.

The high bass speaker monomer 20 comprises a framework 21, a magnetic air loop component 22 and a vibration membrane 23. The framework 21 is formed in a disc shape. A hollow opening 201 is defined at a central position of the framework 21. The magnetic air loop component 22 is disposed at the central position of the framework 21 and located in the hollow opening 201. A hollow structure is formed on the framework 21 and around an outer periphery of the magnetic air loop component 22. An isolation ring 211 is formed on the framework 21. The isolation ring 211 divides the hollow structure into at least one high tone region 202 and at least one bass region 203. The high tone region 202 and the bass region 203 are sector-shaped grooves. The high tone region 202 is located near the magnetic air loop component 22, whereas the bass region 203 is located far away from the magnetic air loop component 22. The vibration membrane 23 is disposed on the framework 21 and covers the magnetic air loop component 22, the high tone region 202 and the bass region 203.

The high bass speaker monomer 20 further comprises a cover plate 24. The cover plate 24 is fixed to the framework 21 and disposed above the vibration membrane 23 so that the cover plate 24 covers the vibration membrane 23. A set of sound holes is formed on the cover plate 24. In this preferred embodiment, the set of sound holes includes a first sound hole 204 and a second sound hole 205. The first sound hole 204 communicates with the high tone region 202. The second sound hole 205 communicates with the bass region 203. Furthermore, a plurality of first sound holes 204 and a plurality of second sound holes 205 can be formed on the cover plate 24. The first sound holes 204 and the second sound holes 205 are circumferentially arranged. The second sound holes 205 are arranged around an outer periphery of the first sound holes 204.

A chamber 101 is enclosed by an interior of the casing body 10. The high bass speaker monomer 20 is mounted within the chamber 101. A division cover 30 is connected to a lower portion of the isolation ring 211, and the division cover 30 is located below the magnetic air loop component 22. The division cover 30 is disposed within the chamber 101 to divide the chamber 101 into at least two sound rooms for receiving sounds with different audio frequencies. In this preferred embodiment, a first sound room 102 and a second sound room 103 are included. The second sound room 103 is located around an outer periphery of the first sound room 102 to surround the first sound room 102.

Specifically, in this preferred embodiment, the casing body 10 includes a rear casing 11 and an annular baffle 12 fixed to the rear casing 11. The chamber 101 is enclosed by combining the annular baffle 12 with the rear casing 11. The high bass speaker monomer 20 is embedded in an inner wall of the annular baffle 12. An annular ear cap 40 is fixed to a surface of the annular baffle 12. The annular ear cap 40 is in direct contact with human's ears.

In use, sounds coming out from the high bass speaker monomer 20 spread outwards. The spread of the sounds is around a sound source. The volume of the place located nearest the sound source is the loudest, whereas the volume of the place where the sounds spread around is gradually down. Because the first sound hole 204 is located nearest the sound source, the high tone enters from the first sound hole 204 into the first sound room 102 and surrounds. Because the second sound hole 205 is located farthest from the sound source, the low tone enters from the second sound hole 205 into the second sound room 103 and surrounds.

This invention takes advantage of at least one division cover connected to the speaker to divide the chamber into at least two sound rooms and arranges sound holes communicating with the sound rooms on the speaker, thereby allowing the high tone and the low tone to enter different sound rooms and prevent the high tone from mixing with the low tone. Therefore, the sound of the earphone is more stable and the quality of the sound is better. Further, there can be multiple first sound holes and second sound holes formed on the cover plate. The first sound holes and the second sound holes are circumferentially disposed, and the second sound holes are arranged around an outer periphery of the first sound holes whereby high tones enter from the first sound holes into the first sound room evenly and low tones enter from the second sound holes into the second sound room evenly. Therefore, the homogeneity and stability of the sound of the earphone can be increased.

While the embodiment in accordance with this invention is shown and described, it is noted that further variations and modifications may be made without departing from the scope of the invention.

I claim:

1. A high bass speaker monomer comprising a framework comprising a hollowed central portion and a circumferential portion located outside the hollowed central portion in a radial direction and circumferentially surrounding the hollowed central portion, a magnetic air loop component and a vibration membrane, said magnetic air loop component being disposed in the hollowed central portion of said framework, the circumferential portion of said framework comprising a hollow structure around an outer periphery of said magnetic air loop component and located outside said magnetic air loop component in the radial direction, an isolation ring being formed on said framework and extending circumferentially around said hollowed central portion, said isolation ring dividing said hollow structure into one high tone region and one bass region respectively located on opposite sides of said isolation ring in the radially direction and both located outside said magnetic air loop component in the radial direction, wherein said high tone region is located near said magnetic air loop component in the radial direction, and said bass region is located far away from said magnetic air loop component in the radial direction, said vibration membrane being disposed on said framework and covering said magnetic air loop component, said high tone region and said bass region;

wherein said high tone region comprises first openings formed therein and arranged circumferentially around and located radially outside said magnetic air loop component and said bass region comprising second openings formed therein and arranged circumferentially around and located radially outside said isolation ring, said first and second openings being separated from each other in the radial direction by said isolation ring.

2. The high bass speaker monomer as claimed in claim 1 further comprising a cover plate, said cover plate being fixed to said framework and covering said vibration membrane, a set of sound holes being formed on said cover plate.

3. The high bass speaker monomer as claimed in claim 2, wherein said set of sound holes comprising a first sound hole and a second sound hole, said first sound hole communicating with said high tone region, said second sound hole communicating with said bass region.

4. The high bass speaker monomer as claimed in claim 3, wherein a plurality of said first sound holes and a plurality of said second sound holes are formed on said cover plate, said first sound holes and said second sound holes being circumferentially arranged, said second sound holes being arranged around an outer periphery of said first sound holes.

5. The high bass speaker monomer as claimed in claim 1 further comprising a division cover, said division cover being connected to a lower portion of said isolation ring and located below said magnetic air loop component.

6. A high bass earphone structure comprising a casing body and said high bass speaker monomer as claimed in any of claims 1-4, wherein a chamber is enclosed by an interior of said casing body, said high bass speaker monomer being mounted within said chamber, wherein said chamber is divided into sound rooms that are separated from each other and respectively communicate with said first and second openings of said hollow structure of the circumferential portion of said framework.

7. The high bass earphone structure as claimed in claim 6, wherein said casing body includes a rear casing and an annular baffle fixed to said rear casing, said chamber being enclosed by combing said annular baffle with said rear casing, said high bass speaker monomer being embedded in an inner wall of said annular baffle.

8. The high bass earphone structure as claimed in claim 7, wherein an annular ear cap is fixed to a surface of said annular baffle.

9. The high bass earphone structure as claimed in claim 6, wherein said high bass speaker monomer further comprises a division cover connected to a lower portion of said isolation ring and located below said magnetic air loop component, said division cover being disposed within said chamber to divide said chamber into said sound rooms for respectively receiving sounds with different audio frequencies, said sound rooms comprising a first sound room and a second sound room respectively communicating with said first and second openings of said hollow structure, said second sound room being located around an outer periphery of said first sound room for surrounding said first sound room.

* * * * *